US005351407A

United States Patent [19]

Van Drielen

[11] Patent Number: 5,351,407

[45] Date of Patent: Oct. 4, 1994

[54] BOW ANGLE TUNER

[76] Inventor: Thomas R. Van Drielen, 4326 Silva Ave., San Jose, Calif. 95118

[21] Appl. No.: 992,135

[22] Filed: Dec. 17, 1992

[51] Int. Cl.[5] ..... G01B 5/00

[52] U.S. Cl. ..... 33/506; 33/265; 33/474

[58] Field of Search ..... 33/506, 474, 482, 265; 124/88, 89, 90, 91, 24.1

[56] References Cited

U.S. PATENT DOCUMENTS

| | | | |
|---|---|---|---|
| 3,651,578 | 3/1972 | Saunders et al. | 33/506 |
| 4,398,354 | 8/1983 | Finlay | 33/506 |
| 4,594,786 | 6/1986 | Rezmer | 33/506 |
| 4,999,922 | 3/1991 | Loggins | 33/474 |
| 5,060,627 | 10/1991 | Fenchel | 124/88 |
| 5,175,937 | 1/1993 | Emerson, III | 124/88 X |

*Primary Examiner*—Willaim A. Cuchlinski, Jr.
*Assistant Examiner*—Alvin Wirthlin

[57] ABSTRACT

A bow angle tuner for aligning an arrow to an archery bow, for precise arrow flight, while the arrow is in the bow, by measurements or comparisons which integrate a minimum of five mechanical bow adjustments, and the diameter of the arrow. A planar member includes a groove, either angular or circular, on one face in which an arrow, of any commercially available diameter, is releaseably secured. One or more rulers, of suitable and equal length, are releaseably attached to, or integral to, the planar member and positioned in such a manner that the rulers form an included angle of less than one hundred eighty degrees and the included angle is bisected by the groove in the planar member and centers on the groove in the planar member. Measurements from the extremities of the rulers to the intersection of each bow limb to the bow riser allows alignment for vertical arrow flight as an expression of the variable relationship between the angularity of the bow, the vertical location of the arrow rest, the distance from the arrow rest to the bow string, and the diameter of the arrow. Comparative proximity of the rulers to the bow string or bow limb tips while the bow is at rest, and at full draw, allow alignment of the arrow for horizontal arrow flight. One or more posts attach to the rulers, or planar member, and allow comparisons of cable angles for eccentric wheel timing, which is an expression of tiller distance.

2 Claims, 5 Drawing Sheets

BOW ANGLE TUNER

TECHNICAL FIELD

This invention relates generally to archery equipment and more particularly to apparatus for aligning or tuning bows.

BACKGROUND OF THE INVENTION

Accurate arrow launching capability of a typical compound bow is dependent upon five mechanically adjustable variables: upper and lower tiller distance (which is an expression of eccentric wheel timing), location of arrow on the bow string and location of arrow rest vertically (which relates to vertical arrow alignment), and location of arrow rest horizontally (which relates to horizontal arrow alignment). Error in any one or all of these variables will cause deviation in arrow flight.

Because of the five mechanically adjustable variables, bow manufacturers can not specify precisely where an arrow should locate on the string, nor how far an arrow should be positioned away from the riser. The only reference manufacturers supply with a new bow is for the customer to measure and write down the upper and lower tiller measurements. The customer is not informed that these measurements are the manufacturer's measurement of eccentric wheel timing.

When a bow manufacturer sells a bow, either the customer, or an archery shop, adds the accessories to a bow. Accessories include arrow rests, overdraws, arrows, string nocks, etc. Because of the five mechanically adjustable variables, tuning for accurate arrow flight frequently requires in excess of eight hours and occassionally in excess of forty hours. Some archers are never able to tune a bow for accurate arrow flight. Even an archery shop cannot identically tune two identical bows with identical accessories if the accessories are not mounted in precisely the same positions. Even after a bow is accessorized and tuned, retuning is required at regular intervals to compensate for string and cable stretch. Changing any of the five mechanically adjustable variables, or even arrow diameter, requires complete retuning.

BACKGROUND: PRIOR ART

Prior to this invention, there was no means by which measurements could be made for adjusting a compound bow for accurate arrow flight which included the angle of the bow, the distance the arrow is offset above the bow centerline, the distance the arrow rest is located from the string, the timing of the upper and lower eccentric wheels and the movement of the bow limb tips. Various devices relating to calibration of archery bows are disclosed in prior patents.

U.S. Pat. No. 3,651,578 (Saunders, 1972), U.S. Pat. No. 4,398,354 (Findlay, 1983), and U.S. Pat. No. 4,974,576 (Morey, 1990) show variations on determining squareness of the arrow to the bowstring. All of these devices only inform an archer how much the arrow is out of perpendicular to the string. Squareness to the string does not define accurate arrow flight because an arrow is normally out of perpendicular to the string an unknown distance. The unknown distance that an arrow should be out of square to the bow string changes everytime the upper or lower tillers are changed, arrow rest is relocated in any of three axis, or a different arrow size is used. None of these patents relate to eccentric wheel timing or horizontal arrow location.

U.S. Pat. No. 4,596,229 (Bell, 1986) declares a device which allows the archer to position a round button in the vicinity of the arrow nock while the bow is at full draw. The bow is then relaxed, and the archer sights down the arrow and estimates how much adjustment must be made to align the arrow to the string movement. This device is not field useable as it requires a holding rack and string retraction device to hold the bow at full draw while positioning the button. The device is dependent upon visual estimation of deviation since there is no means of measurement. Deviation is evaluated by sighting down the arrow after the bow is relaxed and estimating how much adjustment needs to be made in order to align the position of the nock while the bow is in the relaxed position to the location of the button positioned while the bow was in the drawn position. Estimating is dependent upon the archer's ability to align the axial center of the arrow while the bow is in the relaxed state with the button location indicating the position of the nock in the bow's extended state. There is no compensation for parallax. The device does not address eccentric wheel timing.

U.S. Pat. No. 5,060,627 (Fenchel, 1991) declares a device which allows adjustment of a compound bow by observing the relationship between a constantly tensioned string or strings attached to the bow string and a pointer attached to the bow handle. After tuning the bow to the string, or strings, the archer must position the arrow exactly where the string or strings had been while the device was attached to the bow. The device does not align the arrow to the bow because the arrow is not used with the device. The device does not allow actual measurements but depends on observation of the relationship between the string or strings and the pointers while the bow is repeatedly drawn and relaxed. The device would not be consistent from one archer to another because each archer would apply a different force to the bow, depending on where the bow holding hand contacted the bow handle and where the fingers are positioned on the string, thereby allowing the constantly tensioned string or strings to reflect the archer's pulling forces applied to the bow rather than the propelling forces of the bow applied to the arrow. The device does not address eccentric wheel timing.

SUMMARY OF THE INVENTION

The present invention provides a device for aligning an arrow to a bow for precise arrow flight by means of measurements or comparisons which relate to all five mechanical adjustments on a typical compound bow and includes the diameter of the arrow as a factor in the adjustments.

The present invention provides vertical location of the arrow on the bow string as an expression of the relationship between the distance an arrow rest is located above a bow's centerline, the distance the arrow rest is located from the string, the angularity of the bow, and the diameter of the arrow. These variables can be aligned by direct measurements from the present invention to fixed points on the bow while the present invention is attached to an arrow situated in a bow. To determine vertical location of an arrow on the bow string, the device attaches to an arrow and establishes a known angle to which the difference between the unknown offset angles, generated because the arrow is located above the centerline of the bow, can be aligned. By measuring from a point on the upper leg of the present invention to the pivot pin of the upper limb, and comparing that measurement to a measurement from a point on the lower leg of the present invention to the pivot pin of the lower limb, the point on the bow string where the arrow locates can be adjusted until the two measurements are identical. Vertical location of the arrow on the bow string is established when the upper and lower measurements from the bow to the present invention are the same, indicating that the arrow which bisects and is centered on the known angle of the invention also bisects and is centered on the difference between the unknown offset angles of the bow.

The present invention provides for horizontal location of the arrow to the bow by including means for comparing movement of the bow limb tips to the movement of the invention attached to the arrow. When the invention, which is attached to the arrow, moves parallel to the bow limb tips during a draw, then the arrow is located on the dynamic longitudinal centerline of the bow, allowing horizontal arrow flight.

The present invention includes means for establishing upper and lower tiller distances as an expression of the orientation or timing of the eccentric wheels of the bow by comparing the included angles of the cables connecting the two eccentric wheels of the bow.

The present invention aligns an arrow for vertical arrow positioning and allows for eccentric wheel timing comparisons while a bow is in the static position. By tuning a static bow, the potential for human deviation can be minimized. The present invention allows for static bow adjustments to four of the five mechanically adjustable variables for tuning a bow, and additionally, arrow diameter. Only horizontal arrow location requires dynamic tuning.

Tuning a bow in the static position is dynamically accurate. An arrow tuned to a bow while the bow is in the relaxed position, also yields accurate tuning at the moment when the arrow is released from full draw. The typical two wheel commercial compound bow is a closed and balanced system. A cable is attached to the lower limb axle, adjacent to the lower eccentric wheel. The cable extends to the upper eccentric wheel, wraps around the upper eccentric wheel and then extends downward to attach to the bow string. Another cable attaches to the upper limb axle, adjacent to the upper eccentric wheel, extends to the lower eccentric wheel, wraps around the lower eccentric wheel, and extends upward to attach to the bowstring. Any force applied to the upper limb will communicate to the lower limb. Any force applied to the lower limb will communicate to the upper limb. The upper and lower limb forces balance each other. Even though an archer induces uneven loads on the bow at full draw, when the arrow is released, the limb forces instantly rebalance.

Static tuning of a bow yields accurate dynamic tuning because accuracy of arrow flight is most determined at the moment a launched arrow leaves the bow string. The arrow must be aligned at the moment the arrow leaves the bow string or the arrow flies erratically. The attitude of the bow when a released arrow leaves the bow string is the same attitude of a static bow. Consequently, if a bow is tuned in the static position, the bow will also be tuned at release of an arrow.

The present invention aligns a bow and an arrow as a unit, allows for every adjustable variable on a bow including arrow diameter, is light weight, portable, and of simplicity for the novice archer.

A bow tuning device for adjusting accurate flight of an arrow has a planar member containing a groove on one face in which an arrow, of any commercially available diameter, can be releasably secured. Rulers, of equal length, with or without markings, are attached to the planar member, and situated in such a manner that the rulers form an included angle of less than one hundred eighty degrees and the groove of the planar member bisects and is centered on the included angle of the rulers. An arrow is aligned to the bow for vertical arrow flight by measuring and equalizing the distance from the tip of the upper included angle ruler to the upper limb pivot pin and the distance from the tip of the lower included angle ruler to the lower limb pivot pin. The rulers, angularly positioned on the planar member, also establish a distance from the bow string for aligning the arrow to the bow for horizontal arrow flight. Horizontal alignment of the arrow to the movement of the bow can be evaluated by drawing the bow and observing the change in the horizontal distance from the angularly positioned rulers to the string or the cables.

An embodiment of the bow tuning device to allow the timing of the bow's eccentric wheels by changing tiller distances includes, a post, or posts, either radially grooved or straight, attached, either permanently or releaseably, to one or more of the rulers, or the planar member, allowing comparison of the upper and lower angles formed by the bow cables. The post is positioned within the angle formed by the cables of the bow, near an eccentric wheel. The post is then moved toward the vertex of the angle formed by the cables until the post simultaneously contacts each of the cables of the bow. Contact with each of the cables establishes that the cables are a predetermined distance apart, the diameter of the post being the predetermined distance. Measuring the distance from the eccentric wheel axle to the point where the post simultaneously contacts each of the cables of the bow, and then measuring with the same procedure on the opposite end of the bow. The two measurements provide a proportional comparison of eccentric wheel timing. Eccentric wheel timing is adjusted by turning one or more limb bolts until subsequent procedural measurements, on opposing ends of the bow, are identical.

An embodiment of the bow tuning device includes one or more graduated scales, either rigid or collapsible, one end of which is pivotally attached to an angular ruler. The other end of the graduated scales contact the upper or lower limb of the bow, near the limb pivot pin, and allow measurement while the bow is relaxed and at full draw.

An embodiment of the bow tuning device for adjusting the horizontal arrow rest location includes one or more elastomer or constant tension devices which, on one end, attach to each end of the string, or cable, near the eccentric wheels of a bow and, on the other end, attach to one or more posts positioned on the angular rulers in such a manner that the elastomers contact each post at the same distance from the angle rulers as the angle rulers are located from the center of the arrow, thus establishing a plane between the bow string, the posts, and the arrow. When the bow is drawn, the stretch force of the elastomers, or constant tension devices, align the posts attached to the angular rulers which are attached to the planar member which is attached to the arrow, allowing the stretch forces of the elastomers, or constant tension devices, to align the arrow to the plane established by the string, or cables, and the posts attached to the angular rulers. Horizontal adjustment of the arrow rest would be determined by drawing the bow with the arrow rest removed and then locating the arrow rest to the arrow when the bow is in the drawn state.

An embodiment of the bow tuning device for horizontal arrow rest location includes one or more elastomer or constant tension device which are clamped to the both the upper and lower limbs near the eccentric wheels and allow comparison between the movement of the tips of the bow limbs and the movement of the planar member, or the angle rulers, while the bow is drawn.

An embodiment of the bow tuning device for horizontal arrow rest location includes an elastomer or constant tension device attached to the front of the bow. A string, or flexible wire, attaches to one end of the elastomer or constant tension device, traverses the upper limb, passes through the upper limb yoke or over the eccentric wheel, extends to the lower limb, passes through the lower limb yoke or over the eccentric wheel, and traverses the lower limb to attach to the other end of the elastomer or constant tension device mounted on the front of the bow. The elastomer maintains tension on the string, or flexible wire, when the bow is drawn, allowing comparison between the movement of the limb tips and the movement of the planar member which is attached to an arrow.

DETAILED DESCRIPTION OF DRAWINGS

Figure 1A:
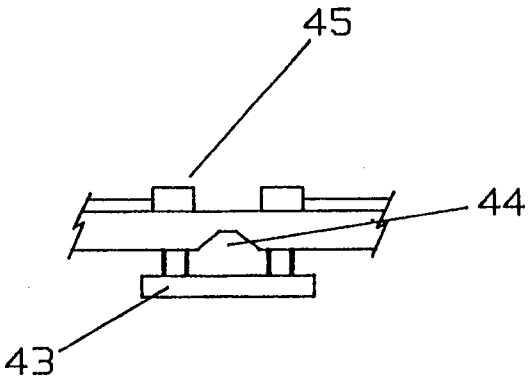
FIGS. 1 and 1A show preferred embodiment of the invention with a supplementary view of the arrow clamping means.
Figure 1:
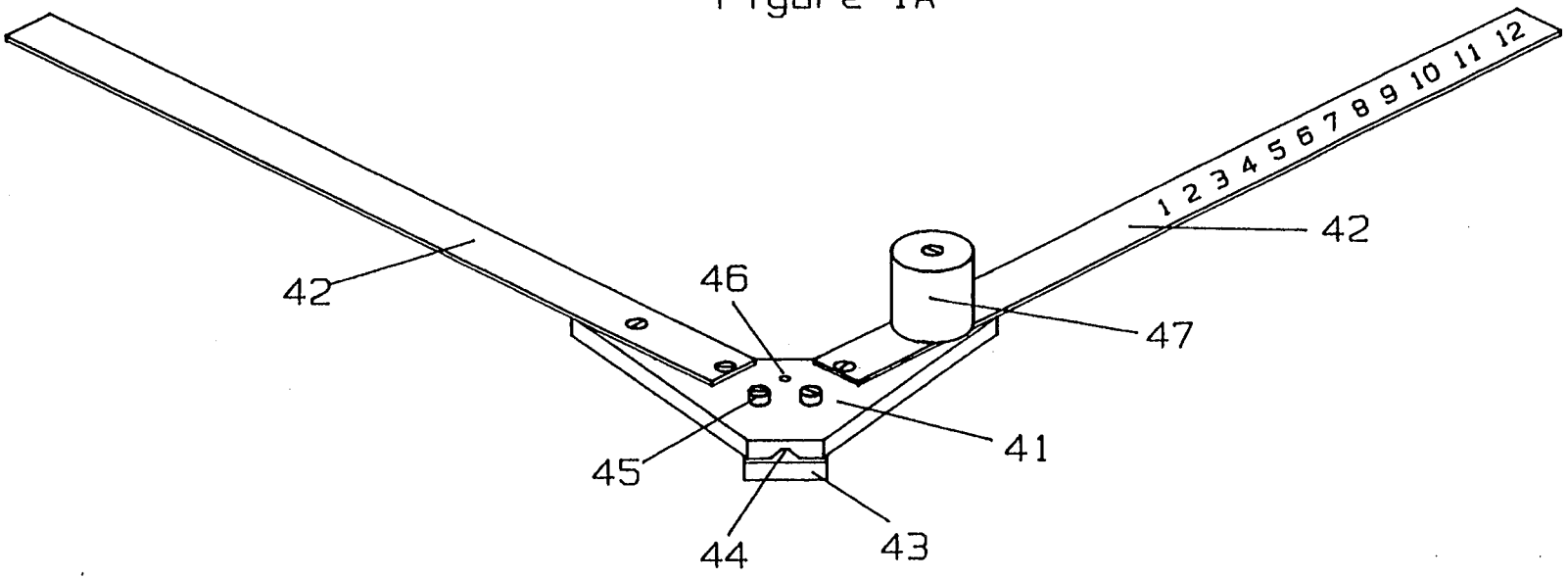

FIG. 1 shows the preferred embodiment of the present invention with a supplementary view illustrating the preferred embodiment for attachment to an arrow. A planar member 41 provides an angular or circular groove 44 for releaseably attaching an arrow (not shown) with bolts 45, passing through the planar member 41 and engaging suitably threaded holes in an arrow clamp 43. Two rulers 42, of equal and suitable length, with or without scales, are integral, permanently attached, or releaseably attached, to the planar member 41, and the rulers 42 are situated in such a manner as to form an included angle of less than one hundred eighty degrees, and the included angle formed by the two rulers 42 is bisected by and centered on the angular, or circular, groove 44 of the planar member 41. A datum mark 46 indicates the projected intersection point of the interior edges of the two rulers 42. One or more posts 47, either radially grooved or straight, are attached, either permanently or releaseably, to one or more of the rulers 42, or to the planar member 41.

Figure 2A:
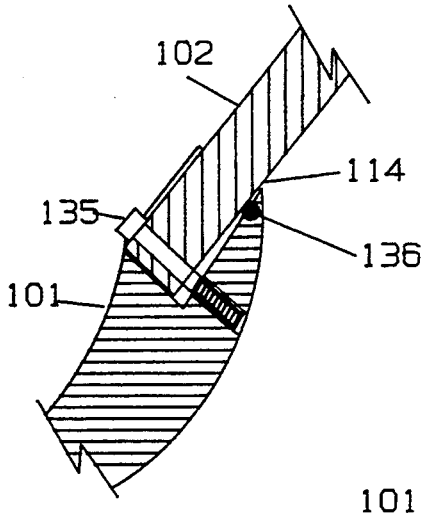
Figure 2A (prior art)
FIGS. 2 and 2A show a typical compound bow with broken lines illustrating the geometry of a bow, a section view shows a typical attachment of a limb to a bow.
Figure 2:
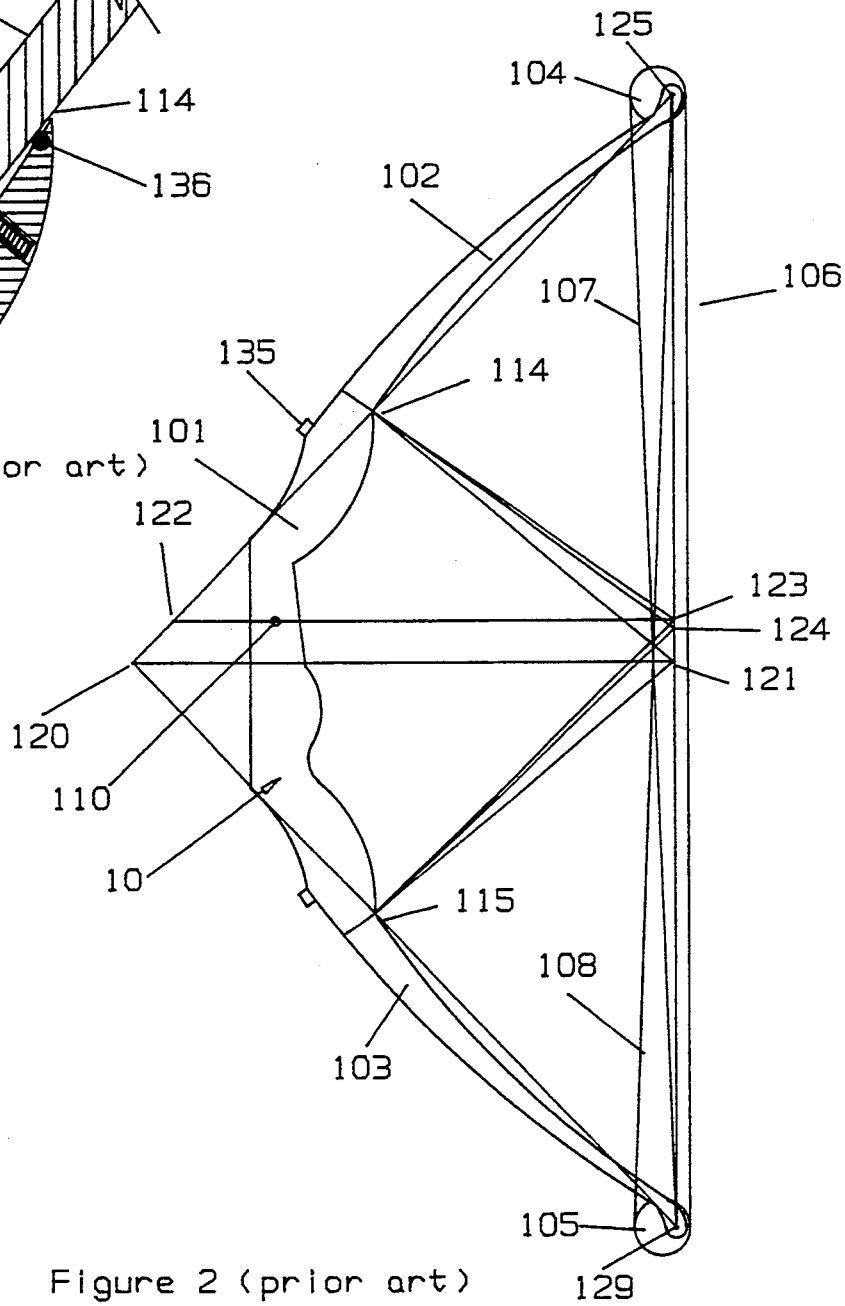
Figure 2 (prior art)

FIG. 2 shows a typical compound bow 10, the compound bow is not part of the present invention and is shown only as the compound bow relates to the function or application of the present invention. A typical compound bow 10 includes a riser 101, an upper limb 102, a lower limb 103, an upper eccentric wheel 104 attached to the upper limb 102 by means of an upper axle 125, a lower eccentric wheel 105 attached to the lower limb 103 by means of a lower axle 129. An upper cable 107 attaches to the lower axle 129 and projects upward at a slight angle to wrap around the upper eccentric wheel 104 and then projects downward to attach to the upper end of the string 106. A lower cable 108 attaches to the upper axle 125 and projects downward at a slight angle to wrap around the lower eccentric wheel 105 and then projects upward to the lower end of the string 106.

The cross section view shows a typical means of attachment for the upper limb 102. The lower limb 103, not shown in crossection, is identical. A riser 101 provides a pocket for receiving an upper limb 102. A limb bolt 135 passes through the limb 102 and threads into the riser 101.

Turning limb bolt 135 causes the limb 102 to pivot around a fulcrum point at pivot pin 136 until tension is applied to the cables 107 and 108 and string 106 via the axles 125 and 129. Pivot pin 136 remains a fixed point on the limb 102 whether the limb 102 is under static tension while the bow is at rest or under dynamic tension when the bow is drawn. Pivot pin 136 is a fixed point on a bow. On most bows, pivot pin 136 is enclosed within the riser 101 and not visible, therefore, fulcrum points 114 and 115 are used as visible reference points in place of enclosed pivot pins.

FIG. 2 includes broken lines which are not physically a part of a bow, but are necessary to illustrate the function of the present invention. All broken lines on FIG. 2 are imaginary lines illustrating the geometry of a compound bow. Descriptions of imaginary geometry use normal geometric notation, two points separated by a comma define a line, and three points separated by commas define an angle or triangle. Imaginary gemometric notations are enclosed in parentheses, for example, imaginary cable line (125,129), in order to distinguish imaginary geometric notations from bow part notations. Bow part notations are not in parentheses, for example the upper eccentric wheel axle is noted as 125 and the lower eccentric wheel axle is 129.

Imaginary upper limb line (125,120) starts at the upper axle 125, passes through the upper fulcrum point 114, and extends in a straight line to intersect with imaginary lower limb line (129,120). Since imaginary upper limb line (125,120) connects two real points on a bow, the upper axle 125 and the upper fulcrum point 114, then imaginary upper limb line (125,120) is an accurate representation for the upper limb 102. Imaginary lower limb line (129,120) starts at the lower axle 129, passes through the lower fulcrum point 115, and extends in a straight line to intersect with the imaginary upper limb line (125,120). Since imaginary lower limb line (129,120) connects two real points on a bow, the lower axle 129 and the lower fulcrum point 115, then imaginary lower limb line (129,120) is an accurate representation of the lower limb 103. Imaginary cable line (125,129) extends from the upper axle 125 to the lower axle 129. Since imaginary cable line (125,129) begins and ends at two real points on a bow, the upper axle 125 and the lower axle 129, then imaginary cable line (125,129) is an accurate representation of a linear relationship between the upper axle 125 and the lower axle 129. Imaginary bow triangle (125,120,129) includes four real points on the bow, the upper axle 125, the upper fulcrum point 114, the lower fulcrum point 115, and the lower axle 129. Since imaginary triangle (125,120,129) includes real points, then imaginary triangle (125,120,129) is an accurate representation of the triangularity of a bow. Imaginary bow centerline (120,121) is the centerline of the imaginary bow triangle (125,120,129), bisects imaginary angle (125,120,129), and, assuming imaginary angle (120,125,121) is equal to imagininary angle (120,129,121), then imaginary bow centerline (120,121) is also perpendicular to the imaginary cable line (125,129). Imaginary bow centerline (120,121) evenly balances the upper and lower bow geometry and represents the geometrical center of symmetry for the bow. Imaginary arrow line 122,123 represents a typical arrow location above the geometrical centerline of the bow and is shown perpendicular to the imaginary cable line (125,129). Imaginary upper offset angle (123,114,121) is created by imaginary lines (114,123) and (114,121). Imaginary upper offset angle (123,114,121) relates the upper fulcrum point 114 with the intersection of imaginary arrow line (122,123) to imaginary cable line (125,129) and the intersection of imaginary bow centerline (120,121) with imaginary cable line (125,129). Imaginary lower offset angle (121,115,123) is created by imaginary lines (115,121) and (115,123). Imaginary lower offset angle (121,115,123) relates the lower fulcrum point 115 with both the intersection of imaginary arrow line (122,123) to imaginary cable line (125,129) and the intersection of imaginary bow centerline (120,121) to imaginary cable line (125,129). The difference between the imaginary upper (123,114,121) and lower (121,115,123) offset angles, is the imaginary resultant offset angle (114,124,115). The imaginary resultant offset angle (114,124,115) would be the angular orientation of an arrow for vertical arrow flight if the arrow rest 110 were located at a distance from the imaginary cable line (125,129) equal to two times the distance from the imaginary cable line (125,129) to the intersection of imaginary fulcrum line (114,115) with imaginary arrow line (122,123). The arrow rest 110 can not, in practice, be located that far in front of the bow. The arrow rest 110, in practice, locates on the bow riser 101 or somewhere between the riser 101 and the bowstring 106. The resultant offset angle (114,124,115) is effected by the location of the arrow rest 110 as a proportion to the length of the imaginary fulcrum line (114,115). The angular orientation of the arrow for vertical arrow flight can be determined by the formula $R=(a-b)(c/d)$, in which "R" is the amount of rotation of the imaginary arrow line (122,123) about the arrow rest 110 expressed as an angle, "a" is the imaginary upper offset angle (123,114,121), "b" is the imaginary lower offset angle (121,115,123), "c" is the distance the arrow is located above the centerline of the bow, which also changes after the diameter of the arrow changes, and "d" is the distance the arrow rest 110 is located from the imaginary cable line (125,129). The formula defines a precise intersection point for the rotated imaginary arrow line (122,123) and the imaginary cable line (125,129) at imaginary resultant point (124). Drawing an imaginary angle from the upper fulcrum point 114 to the imaginary resultant point (124), to the lower fulcrum point 115 produces the imaginary resultant angle (114,124,115). Imaginary resultant angle (114,124,115) is the geometric angle of a bow which relates to the present invention. And the present invention is a physical application of the formula $R=(a-b)(c/d)$.

Figure 3:
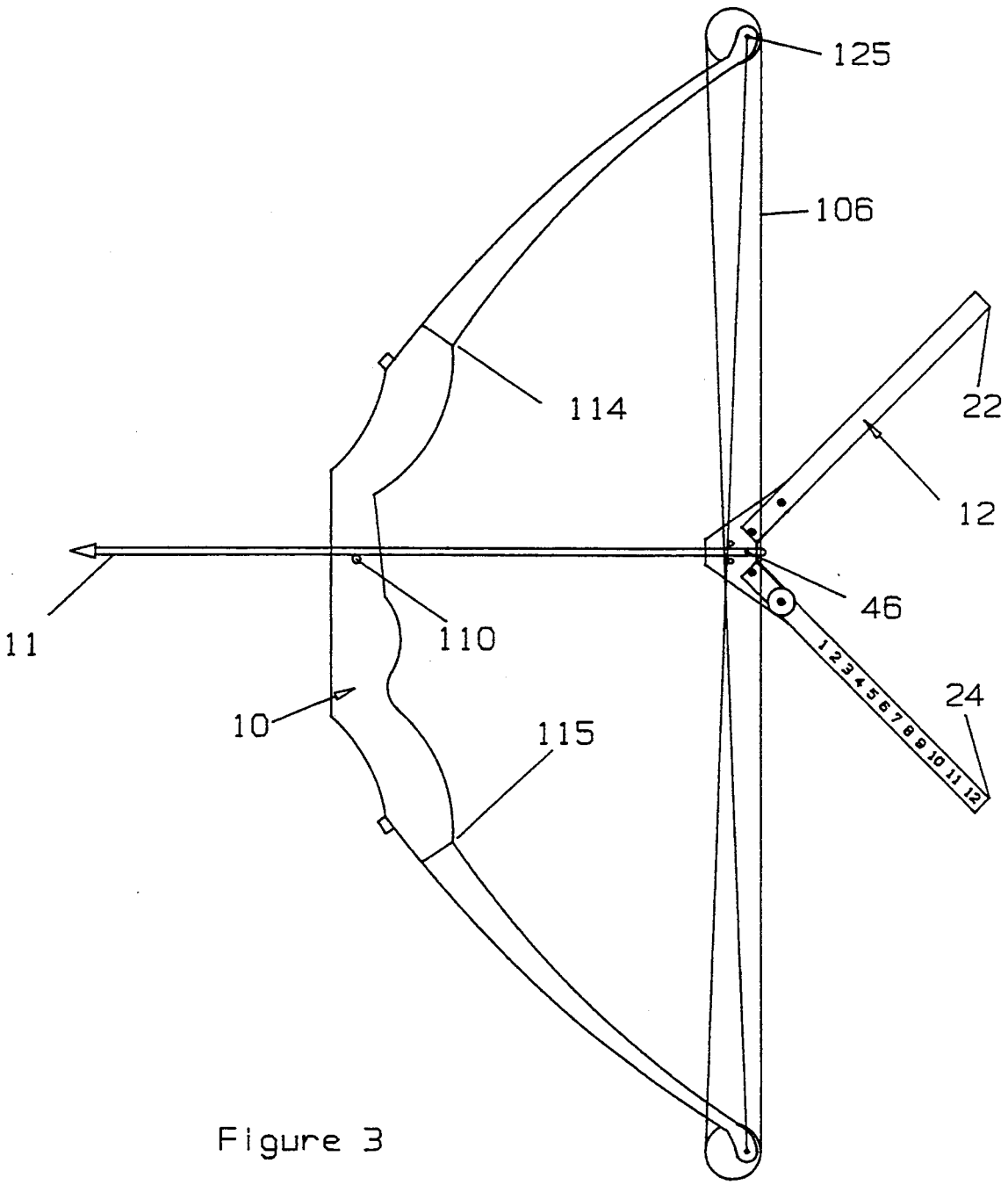
FIG. 3 shows a typical compound bow with an arrow and the preferred embodiment of the present invention for vertical arrow alignment.

FIG. 3 shows a typical compound bow 10 with the present invention 12 attached to an arrow 11. Arrow 11, with the present invention 12 attached, are positioned in the bow with the arrow near perpendicular to the bow string 106 and the nock of the arrow contacting the bow string 106. The present invention 12 is then positioned along arrow 11 until datum hole 46 is located from the bow string 106 at a distance equal to the perpendicular distance from the bowstring 106 to an axle 125. This distance is maintained during subsequent procedures. A measurement is taken from upper fulcrum point 114 to corner 22 of the present invention 12. Another measurement is taken from lower fulcrum point 115 to corner 24 of the present invention 12. The arrow 11, with the present invention 12 attached, is rotated around arrow rest 110 until the measurements are equal.

When measurements are equal, then datum mark 46 is at the same location as the imaginary resultant point (124) of drawing 3, and the arrow 11 bisects both the present invention and the imaginary resultant angle (114,124,115) of drawing 3. When measurements are equal, the arrow 11 has rotated around arrow rest 110 according to the formula $R=(a-b)(c/d)$, and a relationship is established between the angularity of the bow, the location of the arrow rest above the centerline of the bow, location of the arrow rest from the string, location of the arrow on the string, and diameter of arrow. When measurements are equal, the arrow 11 is aligned for vertical arrow flight.

Figure 4:
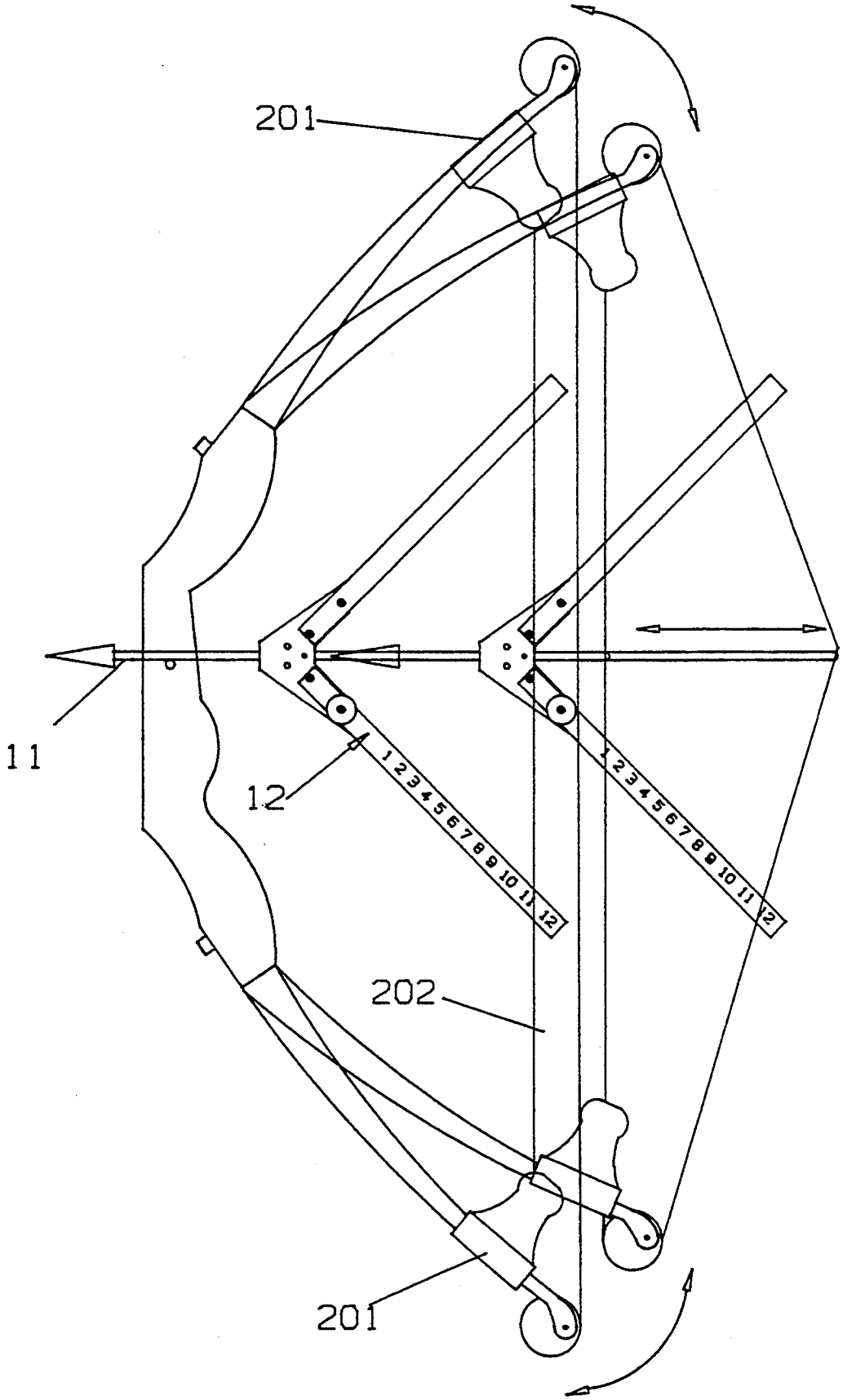
FIG. 4 shows a typical compound bow, an arrow, and the preferred embodiment of the invention for horizontal arrow alignment.
Figure 5:
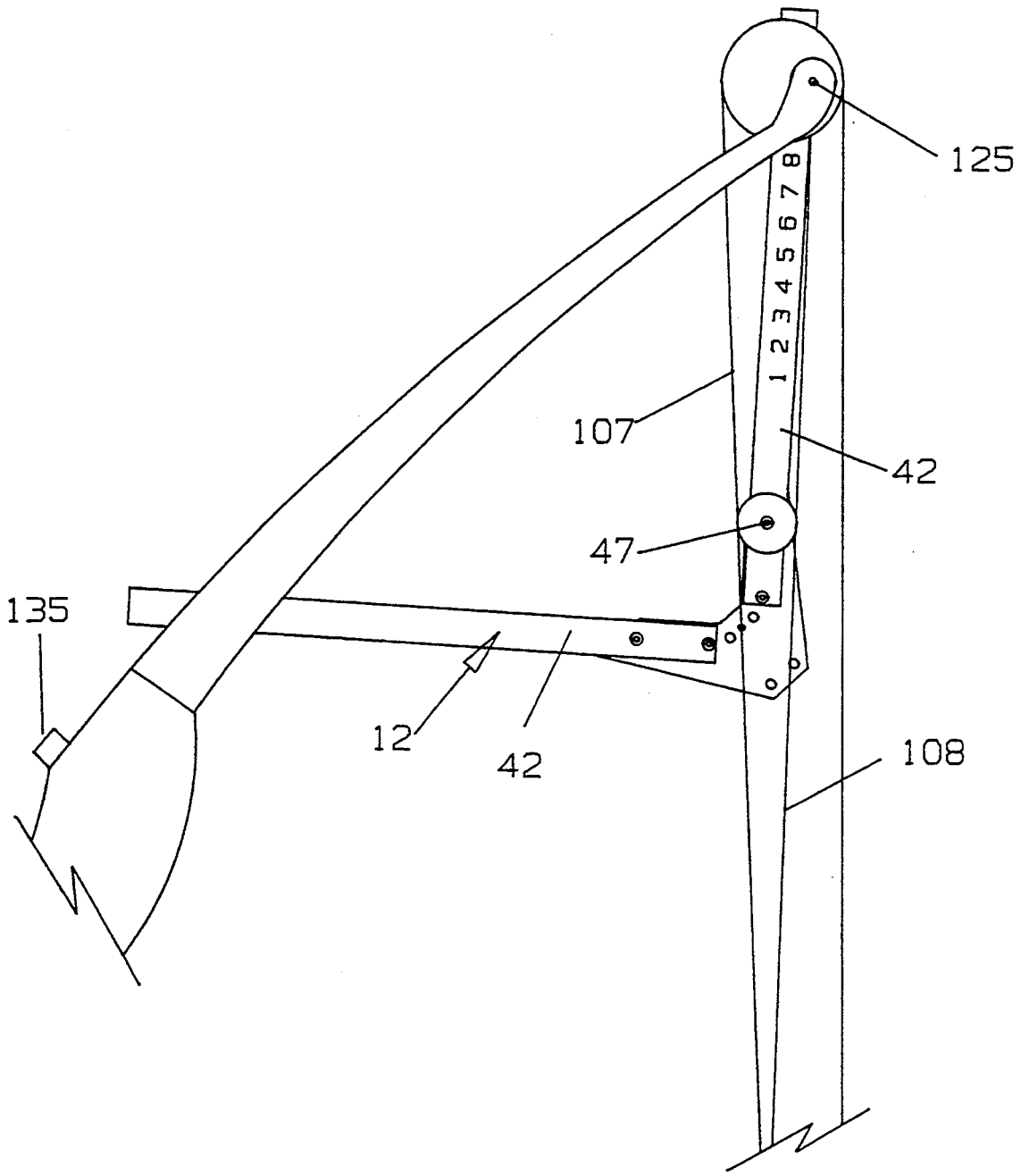
FIG. 5 shows an enlarged view of the upper end of a typical compound bow and the preferred embodiment of the present invention for eccentric wheel timing.

FIG. 4 shows a typical compound bow relaxed and fully drawn with the preferred embodiment of the present invention 12 attached to arrow 11. Two clamps 201, connected by an elastomer or constant tension device 202, are clamped to a relaxed bow. The clamps 201 allow positioning of the elastomer, or constant tension device 202, in close proximity to the preferred embodiment of the present invention 12. When the bow is drawn, the elastomer, or constant tension device 202, reduces length while maintaining a constant straight line relationship between the moving limbs. If the arrow is not positioned horizontally to align the arrow to the movement of the limb tips, the proximity of the elastomer, or constant tension device 202, to the present invention will change. When the present invention 12 attached to arrow 11 moves parallel to the movement of the limbs tips, then the proximity of the elastomer or constant tension device 202 to the present invention 12, established when the bow was relaxed, will remain constant when the bow is at full draw. When the proximity is constant, the arrow is aligned to the movement of the limb tips and also aligned for horizontal arrow flight.

Drawing 5 shows an enlarged section of a typical compound bow with the post 47 of the present invention 12 inserted into the small angle created by the upper cable 107 and the lower cable 108. Post 47 is moved toward the opposite end of the bow until the post 47 contacts both the upper 107 and the lower 108 cables. A linear measurement is taken from the center of post 47 to the center of axle 125. The bow is turned upside down and the same procedure is repeated for the opposite end of the bow. Any difference in measurements is a proportional comparison of eccentric wheel timing. Turn limb bolt 135 and repeat the procedure until the measurements at both ends of the bow are the same.

What is claimed is:

1. A bow turning device allowing alignment of a bow to an arrow for vertical arrow flight, comprising:

a planar member containing an elongate groove means for releasably securing an arrow therein;

first and second rulers of equal length, said rulers being attached to said planar member such that said rulers form a fixed angle in a plane parallel to said planar member of less than one hundred eighty degrees, the vertex of said fixed angle bisecting said groove means and being centered therein; and a clamp having attaching means therein for releasably attaching said clamp to said planar member, thereby releasably securing said arrow in said groove means.

2. A bow turning device of claim 1, wherein said first and second rulers are calibrated on a surface thereof, a cylinder being attached to one of said calibrated rulers.

* * * * *